United States Patent [19]

Weissmann

[11] 4,273,216

[45] Jun. 16, 1981

[54] SAFETY JACKET

[76] Inventor: Rita H. Weissmann, 200 E. 64th St., New York, N.Y. 10021

[21] Appl. No.: 62,917

[22] Filed: Aug. 2, 1979

[51] Int. Cl.[3] ..... A62B 35/00; A62B 1/16

[52] U.S. Cl. ..... 182/3; 2/94

[58] Field of Search ..... 182/3, 4, 5, 6, 7, 8, 182/9, 129; 2/94

[56] References Cited

U.S. PATENT DOCUMENTS

| | | | |
|---|---|---|---|
| 2,970,316 | 2/1961 | Silin | 2/94 |
| 2,979,153 | 4/1961 | Hoagland | 182/3 |
| 3,074,074 | 1/1963 | Lovering | 182/3 |
| 3,176,793 | 4/1965 | Hlacia | 182/3 |
| 3,562,812 | 2/1971 | Greggains | 182/3 |
| 3,973,643 | 8/1976 | Hutchinson | 182/3 |
| 4,076,101 | 2/1978 | Himmelrich | 182/3 |
| 4,177,877 | 12/1979 | Gallinati | 182/3 |

FOREIGN PATENT DOCUMENTS

| | | | |
|---|---|---|---|
| 1420783 | 1/1976 | United Kingdom | 182/3 |

*Primary Examiner*—Reinaldo P. Machado
*Attorney, Agent, or Firm*—Henry R. Lerner

[57] ABSTRACT

A safety jacket adapted to have a line secured thereto for anchoring the wearer of the jacket in the event he loses his footing. The jacket comprises a harness having a pair of shoulder straps and a belt made of polypropylene which is threaded through loops at the ends of the shoulder straps. Each of the shoulder straps is permanently affixed to the jacket by being stitched to the jacket material and to another piece of webbing on the opposite side of the jacket material at several points of attachment. The belt is similarly secured to the jacket at at least one point of attachment. When the jacket is worn, there is no possible relative movement of the harness with respect to the jacket and of the jacket with respect to the wearer, thus permanently maintaining the harness in the desired position.

10 Claims, 7 Drawing Figures

FIG. 1.
PRIOR ART
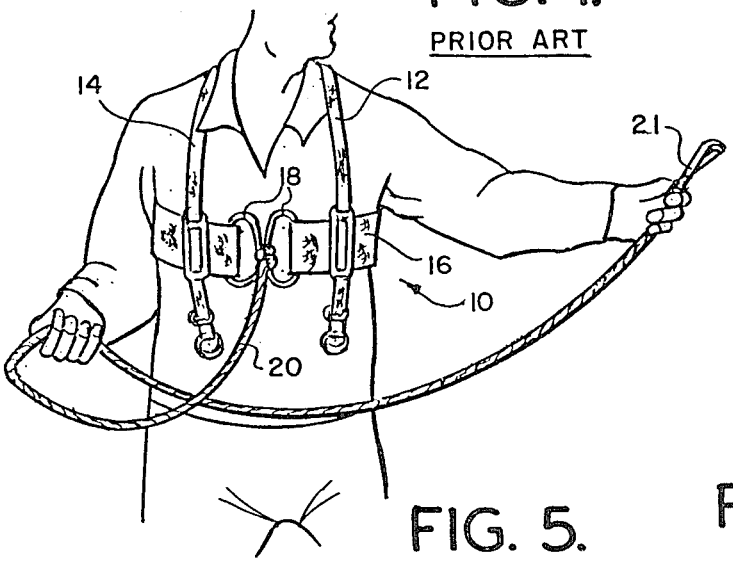
FIG. 7.
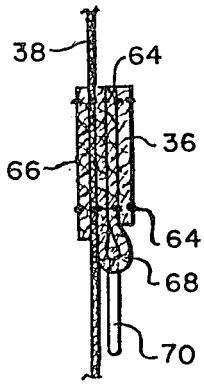
FIG. 5.
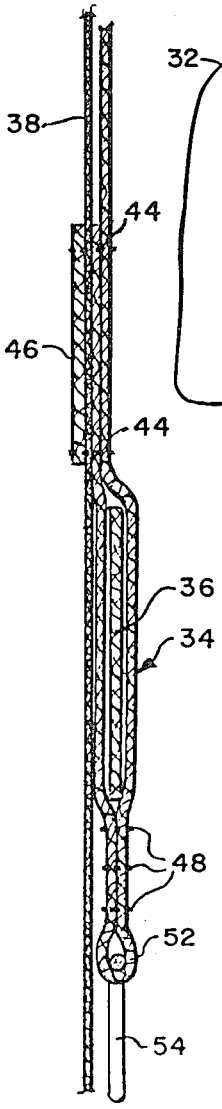
FIG. 3.
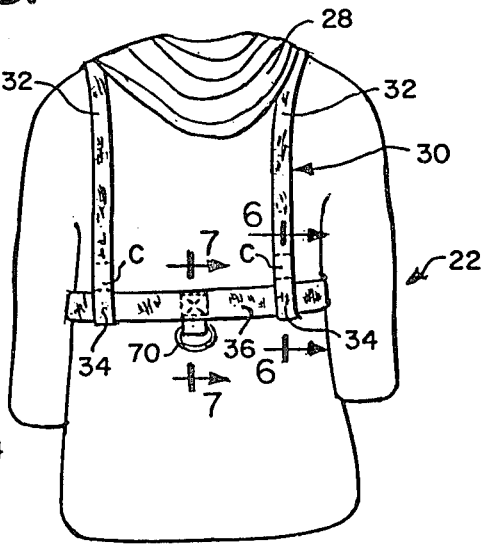
FIG. 2.
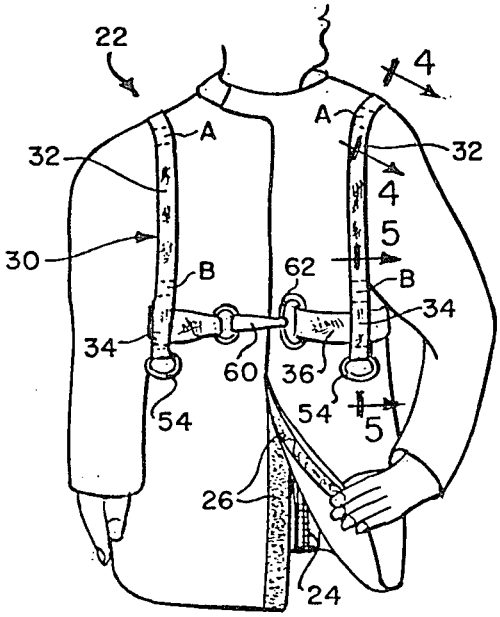
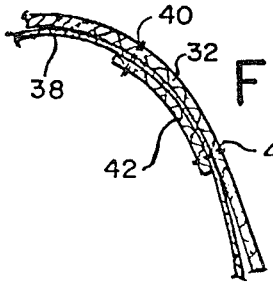
FIG. 4.
FIG. 6.
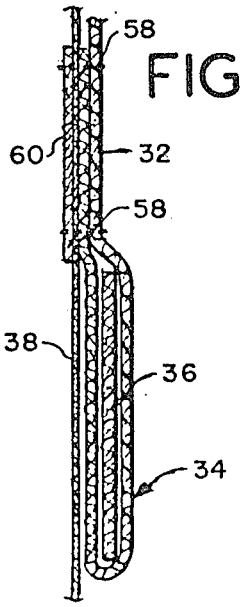

SAFETY JACKET

BACKGROUND OF THE INVENTION

The present invention relates to a safety device of the type which is used on ships and boats or in connection with mountain climbing to enable users thereof to anchor themselves at some predetermined location so that if they lose their footing, they can be retrieved by pulling on the line which connects the safety device to the anchor point.

In accordance with the prior art, the aforementioned purpose is accomplished by providing a harness which is worn by the user, which harness is provided with means for attaching thereto one end of a line, the other end of which is adapted to be secured to the anchor point. Such harness is usually worn over the user's clothing and while it performs its intended function, it does it in a manner which leaves much to be desired. More specifically, such harness includes a number of straps made of webbing which is somewhat slick, whereby said straps are slidable relative to the wearer's body and this creates significant discomfort to the wearer. Furthermore, because of the relative movement between the harness and the wearer's body, in the event of a loss of footing, the wearer may dangle from the anchoring point in undesirable positions in which there is a possibility that some of the straps forming part of the harness will be disengaged from the wearer, significantly interfering with the intended purpose of the harness.

As a result, these harnesses are often felt to be so clumsy, uncomfortable and useless that instead of using them as a matter of proper precaution, they are often left unused creating a substantial risk to one who is involved in racing on water vehicles, such as, sailboats, etc.

The above mentioned disadvantages of prior art harnesses are eliminated in accordance with the subject invention.

SUMMARY OF THE INVENTION

In accordance with the invention, there is provided a jacket made of waterproof fabric, to which there is permanently secured at a plurality of pre-selected locations a harness, such harness being provided with the usual means for securing thereto one end of a line, the other end of which is intended to be secured to an anchoring point. The securement of the harness onto the garment is effectuated in a manner which produces a substantially permanent connection, making it nearly impossible for the harness to be detached or severed from the garment even under great line tension.

By so permanently affixing the harness to the garment, there is substantially no possible relative movement of the harness with respect to the wearer's body, when the jacket is worn. This eliminates not only the discomfort incident to relative movement of harness with respect to body, but also assures the desired position of the body in the eventuality that the wearer loses his footing and is suspended by the line from the anchor point.

Further, since the harness is permanently affixed to the garment, and the garment remains on the wearer at all times, there is literally no likelihood of any part of the harness being disengaged from the wearer as is the case with the conventional harness of the prior art.

BRIEF DESCRIPTION OF THE DRAWINGS

FIG. 1 is a front perspective view showing a safety harness in accordance with the prior art, as worn by a user thereof;

FIG. 2 is a front elevational view of the safety garment in accordance with the invention;

FIG. 3 is a rear elevational view thereof;

FIG. 4 is a sectional view, on an enlarged scale, taken along line 4—4 of FIG. 2;

FIG. 5 is a sectional view, on an enlarged scale, taken along line 5—5 of FIG. 2;

FIG. 6 is a sectional view, on an enlarged scale, taken along line 6—6 of FIG. 3; and FIG. 7 is a sectional view, taken along line 7—7 of FIG. 3.

DESCRIPTION OF THE PREFERRED EMBODIMENT

Referring now to the drawings, FIG. 1 illustrates the conventional prior art safety harness 10 as worn, such safety harness comprising a pair of shoulder straps 12 and 14 adjustably secured to a belt 16, adapted to be closed by interlocking of complementary D-rings 18. A line 20 is secured at one end thereof to the D-rings 18 and is adapted to be secured at the other end 21 thereof to an anchoring point on the vessel.

As shown in FIG. 1, the harness is worn directly over the wearer's shirt with respect to which it is obviously slidable and movable to create the discomfort and disadvantages previously ascribed.

FIGS. 2 and 3 illustrate the safety jacket 22 in accordance with the invention. As shown therein, jacket 22 is generally shaped like a conventional windbreaker and is made of sturdy waterproof material. It is closed by a conventional slide fastener 24 with the resulting overlapping portions being securable by means of complementary "Velcro" elements 26. Further as shown in FIG. 3, a hood 28 may be provided. Preferably, the fabric used for the jacket material is a 70 denier Nylon and 70 denier taslinized Nylon fill. It is Scotch Guarded, rubber backed, windproof, water-resistant up to 150 psi, fire retardant, with all the seams of the garment being sealed.

In accordance with the principal feature of the invention, a safety harness 30 is permanently affixed onto jacket 22, said harness 30 comprising shoulder straps 32 whose free ends define loops 34 through which is threaded a belt 36. Both the straps and the belt are made of sturdy waterproof webbing which is made of polypropylene which is waterproof, fire retardant, and has a tensile strength of 3000 psi which is more than sufficient to easily take up any load to which said webbing is likely to be subjected. The shoulder straps are permanently affixed to the jacket at a plurality of spaced points, as for example points A, B and C on each of the shoulder straps.

The securement at point A, located in the shoulder area, is best illustrated, on an enlarged scale, in FIG. 4, wherein the material 38 of jacket 22 is shown to be stitched to strap 32 by lines of stitching 40, there being provided on the opposite side of fabric 38 an additional segment of webbing 42 also secured by the stitching in order to firm up the securement of the strap to the jacket. In other words, by including inner web portion 42 in the stitching, the jacket fabric 38 is firmly sandwiched between two webs so that any pull exerted on strap 32 will not tend to shear the strap from the jacket itself.

Referring now to FIG. 5, there is shown therein the securement of shoulder strap 32 to jacket material 38 at point B, immediately above the belt 36, by means of stitching 44—44. As previously stated shoulder strap 32 defines at the end thereof loop 34 through which belt 36 is threaded. This is accomplished, as shown in FIG. 5, by doubling up on strap 32 at said end thereof so that stitching 44 secures a double layer of webbing at the outer side thereof as well as a web segment 46 at the inner side so that, as was the case with point A, jacket fabric 38 is again stitchedly sandwiched between webbing at the opposite sides thereof. Further stitching 48 secures the bottom ends of the doubled up strap portions to each other to define the belt loop 34 as well as end loop 52 which holds a metal ring 54.

Referring now to FIG. 6, there is shown the point of securement C immediately above the belt, at the back side of the jacket. As was the case with the securement shown in FIG. 5, shoulder strap 32 is doubled up to define belt loop 34 so that stitching 58, at point C, again stitchedly secures jacket fabric 38 in sandwiched relation between a doubled over layer of shoulder strap webbing 32, at the outer side thereof, and web section 60 at the inner side thereof.

Thus it is seen that each of the shoulder straps is fixedly secured to the jacket immediately above the belt, at the front and the rear, as well as in the shoulder area, to provide unyieldable securement of these shoulder straps to the jacket.

Belt 36 which is threaded through shoulder strap loops 34 is provided at its opposite free ends with snap shackle 60 and D-ring 62 to enable said ends of the belt to be releasably but firmly secured to each other. As shown in FIG. 7, belt 36 is stitchedly secured to jacket fabric 38 at the middle of the back by stitching 64, there being provided again, at the opposite (inner) side of fabric 38, web segment 66, and there being further provided between fabric 38 and belt 36 a doubled up web portion so as to define a bottom loop 68 through which is threaded a ring 70. Thus, the belt is firmly secured to the jacket proper in a manner similar to that in which the straps are secured to the jacket whereby to make it literally impossible for the belt to be detached from the jacket.

An anchoring line, for the aforementioned purposes, may be secured to any one of rings 54, 62 or 70 depending on the particular needs involved. In any case, however, it is apparent that so long as the jacket is worn by the user thereof, the straps and belt forming part of the harness will remain in place as they are totally immovable with respect to the jacket and the jacket is immovable with respect to the wearer, and this condition will be maintained even when the user loses his footing and is suspended primarily by the jacket.

While the jacket has been described herein as being made of a single layer of fabric 38, it is well within the scope of this invention to provide a Nylon lining to the jacket co-extensive with fabric 38 which lining, however, need not be and preferably is not secured to any portions of the harness. Where the lining is provided it will be seen that there is absolutely no physical engagement between any portions of the webbing defining the harness and the body of the wearer. Even where no lining is furnished, there is only limited physical contact of the inner web segments used at the various points of securement.

While the safety jacket in accordance with the invention has been illustrated and described with a specific number of points of securement at specific locations, it will be noted that both the number and location of the securement points may be varied within the scope of the invention.

Further, while there is herein shown and described the preferred embodiment of the invention, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

Having thus described my invention, what I claim and desire to secure by Letters Patent is:

1. A safety jacket adapted to have a line secured thereto for anchoring the wearer of said jacket, comprising, (a) a harness having a pair of shoulder straps and a belt made of webbing, (b) each of said shoulder straps being permanently affixed to the outer side of said jacket at at least one point of attachment, (c) said shoulder straps having loops through which said belt is threaded, and (d) said belt being permanently affixed to the outer side of said jacket at at least one point of attachment.

2. A safety jacket in accordance with claim 1, wherein at each point of attachment said shoulder strap is affixed to the jacket by stitching the shoulder strap webbing to the jacket fabric and to another segment of webbing on the opposite side of said fabric whereby the jacket fabric is stitchedly sandwiched between opposite webbings for permanently securing said shoulder strap to said jacket at said point of attachment.

3. A safety jacket in accordance with claim 1, wherein each shoulder strap is affixed to said jacket at three points of attachment located, respectively, above the belt at the front of the jacket, above the belt at the back of the jacket and adjacent the shoulder area of the jacket.

4. A safety jacket in accordance with claim 3, wherein at each point of attachment said shoulder strap is affixed to the jacket by stitching the shoulder strap webbing to the jacket fabric and to another segment of webbing on the opposite side of said fabric whereby the jacket fabric is stitchedly sandwiched between opposite webbings for permanently securing said shoulder strap to said jacket at said point of attachment.

5. A safety jacket in accordance with claim 2, wherein said webbing is made of polypropylene which is waterproof, fire retardant, and which has a tensile strength of approximately 3000 psi.

6. A safety jacket in accordance with claim 2, wherein the jacket fabric is made of 70 denier Nylon and 70 denier taslinized Nylon fill, Scotch Guarded, rubber backed, windproof, water resistant up to 150 psi and fire retardant.

7. A safety jacket in accordance with claim 6, wherein said webbing is made of polypropylene which is waterproof, fire retardant, and which has a tensile strength of approximately 3000 psi.

8. A safety jacket in accordance with claim 2, wherein said point of attachment of said belt to said jacket is in the middle back at which the belt webbing is stitched to the jacket fabric and to another webbing segment on the opposite side of the jacket fabric which is thereby stitchedly sandwiched between webbings.

9. A safety jacket in accordance with claim 8, wherein said webbing is made of polypropylene which is waterproof, fire retardant, and which has a tensile strength of approximately 3000 psi.

10. A safety jacket in accordance with claim 9, wherein the jacket fabric is made of 70 denier Nylon and 70 denier taslinized Nylon fill, Scotch Guarded, rubber backed, windproof, water resistant up to 150 psi and fire retardant.

* * * * *